US010472190B2

(12) United States Patent
Urrutia Nebreda et al.

(10) Patent No.: US 10,472,190 B2
(45) Date of Patent: Nov. 12, 2019

(54) MEDIA HANDLING SYSTEM

(71) Applicant: HEWLETT-PACKARD DEVELOPMENT COMPANY, L.P., Houston, TX (US)

(72) Inventors: Martin Urrutia Nebreda, Barcelona (ES); Utpal Kumar Sarkar, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 293 days.

(21) Appl. No.: 15/109,061

(22) PCT Filed: Jan. 31, 2014

(86) PCT No.: PCT/EP2014/051867
§ 371 (c)(1),
(2) Date: Jun. 29, 2016

(87) PCT Pub. No.: WO2015/113614
PCT Pub. Date: Aug. 6, 2015

(65) Prior Publication Data

US 2016/0325950 A1 Nov. 10, 2016

(51) Int. Cl.

| | |
|---|---|
| ***B65H 3/20*** | (2006.01) |
| ***B65H 3/46*** | (2006.01) |
| ***B65H 5/02*** | (2006.01) |
| ***B41J 11/00*** | (2006.01) |

(52) U.S. Cl.
CPC ..... *B65H 3/20* (2013.01); *B41J 11/007* (2013.01); *B65H 3/46* (2013.01); *B65H 5/021* (2013.01); *B65H 2301/44335* (2013.01); *B65H 2404/5391* (2013.01)

(58) Field of Classification Search
CPC . B65H 3/20; B65H 3/46; B65H 5/021; B65H 2301/44335; B65H 2301/44334; B65H 2404/5391
See application file for complete search history.

(56) References Cited

U.S. PATENT DOCUMENTS

| | | | | |
|---|---|---|---|---|
| 4,776,575 | A | 10/1988 | Mayer et al. | |
| 5,740,006 | A | 4/1998 | Larkin | |
| 6,042,100 | A | 3/2000 | Jones et al. | |
| 7,845,639 | B2 | 12/2010 | Lyga et al. | |
| 2008/0169003 | A1 | 7/2008 | Curtis | |
| 2013/0101331 | A1* | 4/2013 | Morrow | B41J 3/60 400/621 |

(Continued)

FOREIGN PATENT DOCUMENTS

| | | |
|---|---|---|
| WO | WO2001042030 | 1/2002 |
| WO | WO2013164391 | 11/2013 |

OTHER PUBLICATIONS

Bukkems, et al. A Piecewise Linear Approach Towards Sheet Control in a Printer Paper Path. Proceedings of 2006 American Control Conference Jun. 14-16, 2006.

*Primary Examiner* — Howard J Sanders
(74) *Attorney, Agent, or Firm* — HP Inc. Patent Department

(57) ABSTRACT

An example media handling system provides a print media (111) along a media path (131) and at least part of the media handling system includes an adhesive material for locating the print media (111) on the at least part of the media path (131).

18 Claims, 4 Drawing Sheets

(56) References Cited

U.S. PATENT DOCUMENTS

| | | | | |
|---|---|---|---|---|
| 2013/0340946 | A1* | 12/2013 | Frank et al. | B65C 9/1869<br>156/540 |
| 2013/0341164 | A1 | 12/2013 | Frank et al. | |
| 2015/0183186 | A1* | 7/2015 | Bigelow | B32B 7/06<br>156/249 |

* cited by examiner

MEDIA HANDLING SYSTEM

BACKGROUND

As print media advances along a media path, the media should be located exactly, avoiding any slippage along the media path. The media path may include media pick up, advancement to a print zone, where an image is printed onto the media, post printing processing such as finishing and to media output. For example, the media is to be held at a constant predetermined distance from the pens in the print zone which, invariably, involves holding the print media flat in the print zone, in order to avoid image defects etc.

BRIEF DESCRIPTION OF DRAWINGS

For a more complete understanding, reference is now made to the following description taken in conjunction with the accompanying drawing in which.

DETAILED DESCRIPTION

In a printing system, there are several problems related to media handling. In the case of media pick up, it often happens that more than one sheet of media is picked up, or no sheet is picked up at all. Sometimes the media is dirtied or damaged by the pick-up and separation systems.

In the case of advancing media along the media path, there may be slippage, a discrepancy between the media advance and the advance system itself, causing image quality defects (for example banding).

In the case of media hold-down, if the media cannot be held perfectly flat, there would be a non-constant spacing between the pens and the surface of the media, causing image quality defects or even smears. Hold-down systems, such as, for example, a vacuum may cause deformation of the media at the air inlets, leading to image quality defects. Additionally vacuum systems are noisy, expensive and consume power.

In the case of media output, the systems tend to leave starwheel marks, when starwheels are used for the media output, or ink transfer via a roller, if a roller is used that touches the printed surface of the image.

Media pick-up and transport are largely friction-based. This requires a normal force, having those difficulties as mentioned above; moreover this requires additional parts, like rollers, pinchwheels, star wheels etc.

Figure 1A:
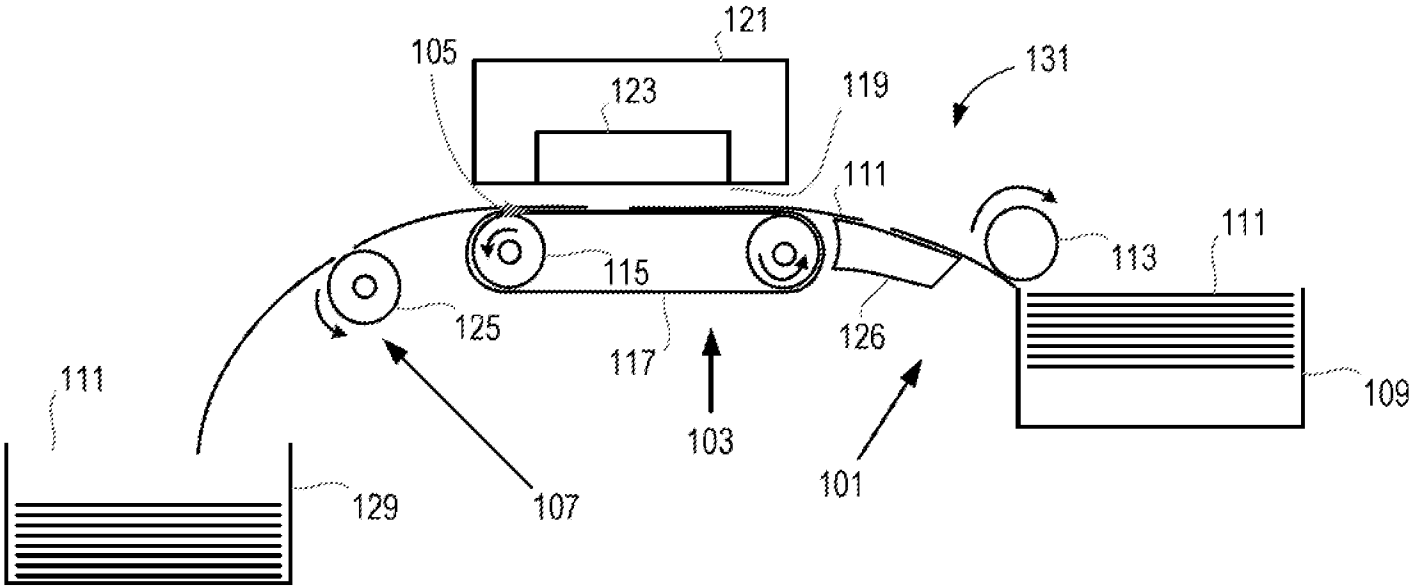
FIG. 1*a* illustrates components of an exemplary media handling system of a printing system.

An exemplary printing system 100 including a media handling system 101, 103, 105, 107 is shown in FIG. 1*a*. The printing system comprises a plurality of elements including, for example, a printhead 121, transport rollers 113, 115, 127, belt(s) 117, media storage trays 109, 129 etc. A subset of these elements constitutes a media handling system comprises a media-pick-up subsystem 101, a media-transport subsystem 103, a media-hold-down subsystem 105 and a media-output subsystem 107. The media path may also include post printing processing such as finishing (not shown here).

Figure 1B:
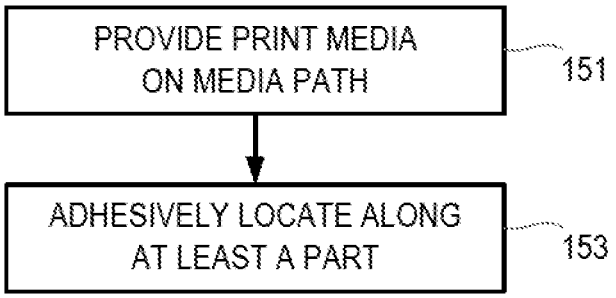
FIG. 1*b* is a flow diagram of an example of a method of handling print media.

At least a part of the media handling system (or at least one element of the printing system), for example, the media-pick-up subsystem 101, media-transport subsystem 103, media-hold-down subsystem 105 and/or the media-output subsystem 107 includes an adhesive material for locating the print media 111 on the media path 131. The print media 111 is handled, as illustrated in FIG. 1*b* by providing, 151, a print media along a media path; and adhesively locating, 153, the print media along at least part of the media path. Locating the print media 111 includes positioning the print media 111 correctly along the media path 131, correctly orientating the print media 111 within the print zone 119 and providing the print media 111 at the correct and constant distance from the pens 123 within the print zone 119. The adhesive material may be a multi-mode adhesive material, for example, an adhesive material which exhibits different adhesive properties in different modes of operation. For example, in a first mode of operation, the adhesive material exhibits strong attraction forces to enable adhesion and a second mode of operation in which the adhesive material exhibits weak attraction forces so that no adhesion occurs or, at least, easy detachment is achieved.

The adhesive material may comprise a multi-mode adhesive material which is characterised by the properties of a high pull of to preload ratio, a low detachment force, not degenerating independent of the number of attach-detach cycles, for example no degeneration of adhesion after more than 1,000,000 cycles; being material independent in that it attaches to a surface of any material, for example, a Gecko-inspired Synthetic Adhesive (GSA). An example of one type of these adhesive materials is a frictional adhesive material which has the characteristic of a high sheer adhesion coefficient, for example >5, (the shear adhesion coefficient is the ratio of pull-off shear stress to normal preload stress) such that only light contact is needed to engage the adhesive and having a low detachment force when a shear force is not applied, for example, <0.1 N/m. This means that adhesion is achieved by applying very little pressure, but detaching or displacing by applying a perpendicular force or a shear force requires a large amount of force.

Alternatively, the multi-mode adhesive material may comprise a switchable adhesive material which switches modes such that in a first mode the material has adhesive properties and in a second mode it has no adhesive properties. These switchable adhesive materials are switched between the first and second modes by the application of external influences, for example, strain, UV-light, electric or magnetic fields, and the like, for example, strain switchable adhesive materials become adhesive when a strain is applied, and lose their adhesive properties when the strain is released; or UV switchable adhesive materials, which become adhesive when UV light is applied, and lose their adhesive properties when the UV light is removed; or electrically switchable adhesive materials, which become adhesive when an electric field is applied, and lose their adhesive properties when the electric field is removed; or magnetically switchable adhesive materials, which become adhesive when a magnetic field is applied, and lose their adhesive properties when the magnetic field is removed.

Figure 3A:
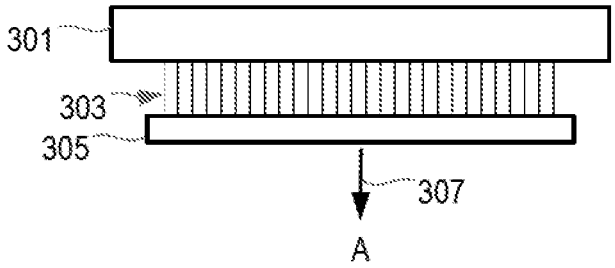
FIGS. 3*a, b* and *c* illustrate the properties of Gecko-inspired adhesives (GSA)
Figure 3B:
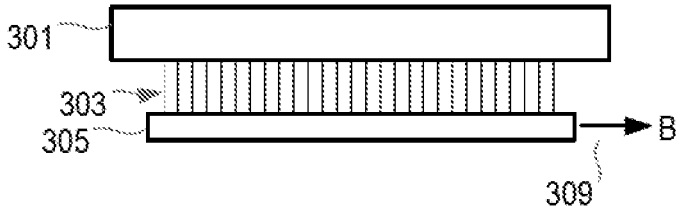
Figure 3C:
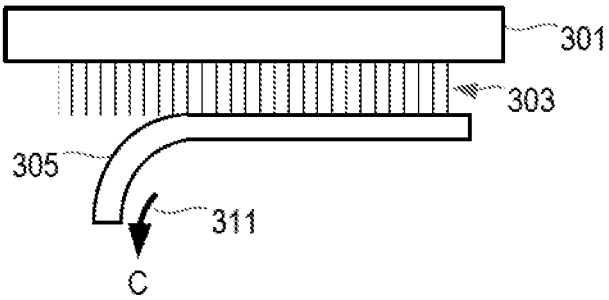

As mentioned above, one example of a multi-mode adhesive is Gecko-inspired Synthetic Adhesive (GSA). These are adhesives based on the functioning of gecko feet. The adhesive properties are caused by van der Waals (intermolecular) forces due to an extremely close contact between the molecules of fibres of the adhesive and of the surface to be adhered to. The van der Waals forces in itself are very small, making it easy to detach when this is done gradually. The gecko detaches by rolling off its toes backward (away from the surface). One example of a type of GSA has frictional adhesive properties, as mentioned above, and is illustrated in FIGS. 3*a*, 3*b* and 3*c*. The surface 301 of a subsystem 101, 103, 105, 107 of the media handling system has an adhesive material 303 applied thereto. An item 305, such as a print media as described in more detail below, adheres to the adhesive material 303 and hence the surface 301 with only light contact. In the of case of a GSA having frictional adhesive properties, the normal pull-off force 307 in the direction of the arrow A is high when a shear force 309 in the direction of arrow B is applied and goes to zero when the sheer force 309 is removed resulting in a low peel-off force 311 in the direction of the arrow C.

The adhesive material may be applied to the media-pick-up subsystem 101 to enable pick-up of single sheets from a stack for input of the media onto the media path. High-end printers often use a complicated and sophisticated suction based pick-up system involving vacuum pumps and a system of tubes and valves with great success but at a high cost. A media pick-up subsystem using a multi-mode adhesive, such as GSA, can replace these systems at a much lower cost. The principle of traditional pick-up systems is that the friction between the pick-up roller and the sheet of paper is higher than that between this sheet and the next. However, to increase the friction, the normal force has to be increased, which will increase both frictions, increasing the risk of picking up more than one sheet. In the case of application of a GSA material, such as for example a frictional adhesive material, the friction, or rather the adhesive shear force typically has a very small dependency on the normal force, so that only light contact is needed to adhere the top sheet to the adhesive material of the media-pick-up subsystem and therefore this problem doesn't occur anymore.

Media 111, for example, in the form of preformed sheets is picked up one sheet at a time by the media-pick-up subsystem 101 from a storage tray 109. This may be achieved by raising the sheets of print media 111 by, for example, a spring-biased loaded tray 109 to meet the surface of a pick-up roller 113 positioned above the storage tray 109. Alternatively, a pick-up roller 113 is lowered onto the top sheet of print media 111 within the storage tray 109. The pick-up roller 113 is coated with an adhesive material such as, for example, a GSA. In the example of a GSA having frictional properties being utilised, the shear force 309 applied between the adhesive material of the pick-up roller 113 and the surface of the print media 111 in the direction of rotation of the pick-up roller 113 (hence in the expected direction of advancement of the print media along the media path 131) causes a strong attraction between the adhesive material and the surface of the print media and causes the top sheet of the print media 111 within the storage tray 119 to adhere to the pick-up roller 113 with only light contact therebetween. As a result a single sheet of the print media 111 is obtained from the storage tray 109 and enters the media path 131 to be advanced to the print zone 119.

Alternatively, the media may be in the form of a substantially continuous web and fed by a supply roller into the media path in place of the pick-up roller 113 and storage tray 109.

Once a sheet 111 has been picked up, it advances along the media path 131 such that the media 111 passes either directly onto a belt 117 or onto the belt 117 via a short intermediate support 126 into a print zone 119. This is achieved by the shear force applied between the sheet of media 111 and the adhesive material on the pick-up roller 113 diminishing as the media 111 adhered to the pick-up roller 113 is rotated such that the media easily becomes detached by its own weight as the pick-up roller 113 continues to rotate, without leaving any adhesive material residue on the print media. The print media 111 then advances by operation of the media-transport subsystem 103 (in this example the belt 117) through the print zone 119. The intermediate support 126 is not coated with an adhesive material and is shorter in length than the length of a sheet of the print media 111 and merely provides support for the print media 111 to ensure that the media is positioned such that it comes to rest on the belt 117 as the print media is advances along the media path 131 by the pick-up roller 113.

The belt 117 is driven by a pair of belt rollers 115. Although a pair of rollers 115 is illustrated in FIG. 1*a*, it can be appreciated that additional rollers may be provided therebetween to help increase stability in maintaining a constant speed (if required) and tension of the belt 117 through the print zone 119.

The outer surface of the belt 117 is coated with an adhesive material, for example a GSA. This provides two functions. The first is for the media transport subsystem 103 in providing a substantially continuous stream of media 111 to be advanced through the print zone 119 during the printing process. The second is for the media-hold-down subsystem 105 for holding the media 111 flat onto the surface of the belt 117.

The print media 111 passes the printhead 121 stopping as each swath is printed by pens 123 of the printhead 121 within the print zone 119 and the media 111 is advanced for printing the next swath. Alternatively, an array of pens may be utilised which cover the whole width of the media 111, and then the media 111 is advanced at a substantially constant speed. The image is then printed as the media advances.

In a further alternative arrangement, the belt 117 may be replaced by a series of supports and transport rollers. Each transport roller is coated with an adhesive material to hold down the print media 111 within the print zone and/or advance the print media through the print zone 119.

The adhesive material coated on the outer surface of the belt 117 is used to keep the media 111 perfectly flat and immobile in the print zone 119. The belt 117 is held under tension between the belt rollers 115 such that, in the case of a frictional adhesive material, a shear force between the print media 111 and the belt 117 is maintained from any point on the print media 111 surface keeping the print media 111 perfectly flat and immobile in the print zone 119. Since adhesives, such as, for example, GSAs, the adhesion can withstand a high perpendicular force and a high shear force, the paper will be perfectly flat even if the media has a tendency to expand or contract (due to the absorption of ink, or to heat applied for drying). As a result, media hold-down in the print zone 119 is achieved by the adhesive properties of the adhesive coating of the belt 117. This avoids the need for vacuum or other mechanisms.

If a frictional adhesive is utilised, as the print media 111 advances onto the belt 117 and enters the print zone 119, the movement of the belt due to the rotation of the pair of belt rollers 115 causes a shear force to be applied between the leading edge of the media 111 and the adhesive-coated belt 117 which causes a strong attraction between the print media 111 and the adhesive material with only light contact between the surface of the media 111 and the belt 117. On exit of the print zone 119, as the belt moves over the second of the pair of belt rollers 115, the shear force diminishes and the attraction forces reduce such that the media 111 easily peels off the adhesive coating of the belt by the media's own weight. To assist in the detachment of the print media 111 from the adhesive material of the belt 117, the adhesive material coated on the belt 117 may be applied intermittently such that a small portion of the leading edge of the print media 111 is not in contact with the adhesive material.

Alternatively, the adhesive material applied to the belt 117 may comprise a switchable adhesive material which switches from a first mode in which the adhesive material has adhesive properties and a second mode in which the adhesive material has no adhesive properties. The adhesive material may be switched by a change in strain applied to the adhesive material. This is achieved by the tension in the belt 117 being released as it curves over each of the belt rollers 115. Therefore the switchable adhesive material on the belt 117 between the belt rollers 115 is in a first mode and as tension in the belt 117 is released over the belt rollers, the adhesive material switches to its second mode, and on exit of the print zone 119 releases the print media 111. On entry to the print zone 119, the belt roller 115 causes the tension in the belt 117 to increase switching from its second mode to the first mode causing the print media to adhere to the adhesive material upon entry in the print zone 119. The tension in the belt 117 is maintained through the print zone 119 and therefore the adhesive material remains in its first mode, holding down the print media 111 throughout the print zone 119 and positioning it correctly on the belt Applications to media transport are straightforward; wherever friction is required, GSAs or switchable adhesives can be used to provide the required amount of shear force, without requiring the application of a normal force beyond a certain threshold that is adhesion is achieved with only slight contact and without the need to apply a normal force to cause adhesion.

The media then passes along the media path 131 over a transport roller 125 of a media-output subsystem 107. The transport roller 125 is coated with an adhesive, for example GSA. The transport roller 125 is located beneath the media 111 and above an output bin 129 of the media-output subsystem 107 such that as the media passes over the transport roller 125 it is caused to drop into the output bin 129.

Figure 2:
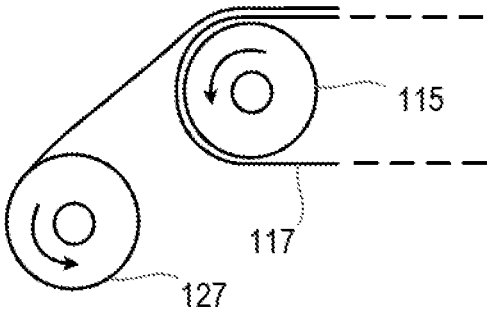
FIG. 2 illustrates a part of the exemplary media handling system of FIG. 1*a* in more detail.

As shown in more detail in FIG. 2 as the media 111 peels off the belt 117, it falls on top of the output roller 127 of the media-output subsystem 107. Alternatively, a short intermediate support may be provided (not shown in FIG. 2) between the end of the belt 117 and the output roller 127. The support is not coated with adhesive material and is shorter in length than the length of a sheet of the media 111 to ensure advancement of the media by the belt 117 and the output roller 127. The support holds the sheet of media 111 in position to ensure contact with the output roller 127. The output roller 127 is coated with an adhesive, for example a GSA. In the case of a frictional adhesive, the shear force applied between the adhesive material and the print media 111 upon contact between the adhesive material and the print media 111 due to the rotational movement of the output roller 127, causes strong attraction force to be generated such that the print media 111 adheres to the adhesive material and hence the surface of the output roller 127 with only light contact.

Conventionally, after the printing is done, the media has to be transported further, which typically involves applying starwheels and rollers, which can cause marks and smears on the paper. The point at which one print is slid over an earlier print to be added to the stack is another point at which smearing can occur. With the media-output subsystem described above, contact with the printed surface of the media 111 is minimised, thus avoiding scratch and smear marks. Alternatively, the media-output subsystem 107 may comprise a second belt similar to the belt 117 having adhesive material, for example a GSA, applied thereto that moves the printed paper down over the output bin 129, and releases it when it is just above the desired location by similar techniques for the belt 117. The printed surface is uppermost avoiding further smearing as the uppermost printed surface continues to dry before the sheet is deposited, as shown, for example, in FIG. 4.

The media 111 exits the print zone 119 as described above and is transported into a receiver 401 by the output roller 127. The receiver 401 is shaped in a substantially semi-spherical shape. The media 11 drops into the receiver 401 such that the printed surface of the media 111 faces downwards.

Figure 4:
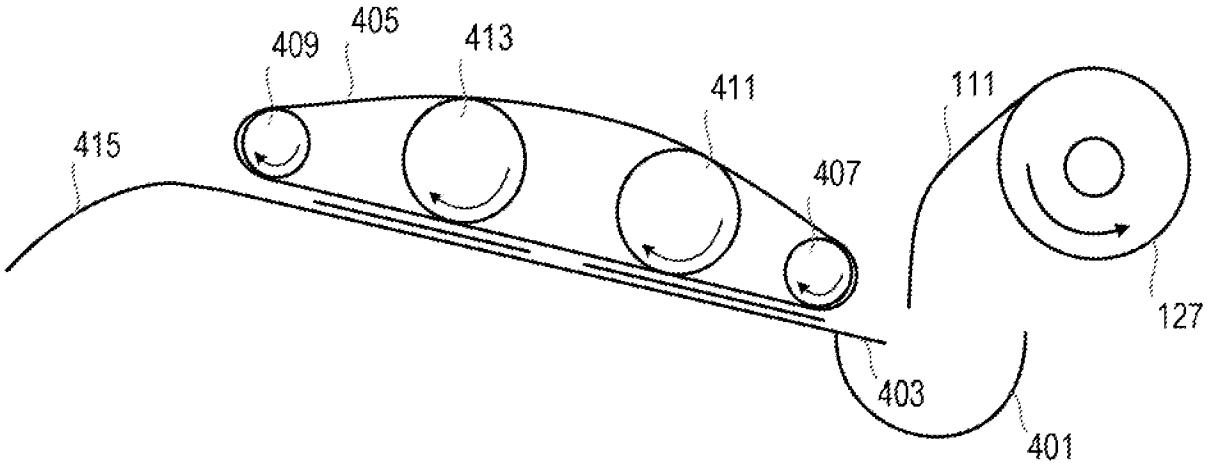
FIG. 4 is an alternative implementation of the media-output subsystem of FIG. 1.

The media 111 is then transported by the output belt 405 positioned above the receiver 401. The output belt 405 is driven by a pair of outer output-belt rollers 407, 409 and a pair of inner output-belt rollers 413, 411. The pair of inner output-belt rollers 413, 411 may be larger in diameter than the outer output-belt rollers 407, 409 as illustrated by FIG. 4, or alternatively, the belt rollers may be substantially the same in size. Although 4 belt rollers are illustrated here, it can be appreciated that any number of rollers may be utilised with at least one pair at each end of the belt. The pick up by the output belt 405 may be assisted by the edge of the media 111 being located in a lip 403 which extends partly into the receiver 401.

The output belt 405 is coated with a switchable adhesive material, for example a strain switchable adhesive material. The adhesive may be switched between a first mode in which the material has adhesive properties and a second mode in which the material has no adhesive properties. As the belt 405 runs over the first of the pair of outer output-belt rollers 407, the adhesive material on the surface of the belt 405 switches to its first mode in which the adhesive material has adhesive properties, an edge of the print media 111 in the receiver 401 adheres to the belt 405. The print media is then picked up from the receiver 401. The adhesive material on the surface of the belt 405 remains in its first mode until it is switched into its second mode as it passes over the second of the pair of outer output-belt rollers 409. At this point, the adhesive material loses its adhesive properties and the print media 111 drops onto a curved support 415 so that the print media 111 continues to fall and is guided by the curved support 415 to drop into an output bin, similar to that of FIG. 1*a*.

The tension in the output belt 405 can be varied by the varying size of the output belt rollers 407, 409, 411, 413 or by moving the pair of outer output belt rollers 407, 409 closer together or further apart. This enables the modes of the adhesive material to be controlled as required.

As a result, the media is not sliding with its printed side over another sheet of media, or having to slide over the printed side of another sheet of media as it is transported to the output bin allowing time for the ink to dry and hence minimising smears.

The GSAs may be based on the technologies of a hard polymer, soft polymer, or carbon nanotube. As the adhesion is based on van der Waals forces, the adhesive materials don't have to be pretreated.

Multi-mode adhesive materials allow, in many ways, handling of the media without having to touch the printed side, of which some examples are described above. Their ability to provide a normal force removes the need for a vacuum system, which is noisy, expensive, and consumes power.

Further, in the description above, the media-pickup, media-transport, media-hold-down and media-output subsystems include an adhesive material. However, it can appreciated that any one of these subsystems may not utilise the adhesive material but may utilise more conventional techniques, for example, the hold-down subsystem may utilise a conventional vacuum system instead of utilisation of the adhesive material, the media-output subsystem may utilise conventional rollers and starwheels instead of utilisation of the adhesive material.

Although various examples have been illustrated in the accompanying drawings and described in the foregoing detailed description, it should be understood that the disclosure is not limited to the examples disclosed, but is capable of numerous modifications without departing from the scope of the disclosure as set out in the following claims.

The invention claimed is:

1. A media handling system for providing a print media along a media path, wherein at least part of the media handling system includes an adhesive material for locating a print media on the at least part of the media path, wherein the adhesive material comprises a multi-mode adhesive material exhibiting different adhesive properties in different modes;

wherein the multi-mode adhesive material comprises a switchable adhesive material that switches between modes responsive to application of an external influence, wherein in a first mode, the adhesive material has adhesive properties and in a second mode has no adhesive properties.

2. The media handling system of claim 1, wherein the system comprises a media-pick-up subsystem configured to retrieve print media and place the retrieved print media on the media path; a media-transport subsystem configured to advance print media along the media path; a media-hold-down subsystem configured to hold the print media flat for at least part of the media path; a media-output subsystem configured to output the print media from the media path, wherein at least one of the media-pick-up subsystem, media-transport subsystem, media-hold-down subsystem and media-output subsystem includes the adhesive material.

3. The media handling system of claim 1, wherein the adhesive material has a sheer adhesion coefficient greater than 5 and a detachment force of less that 0.1 N/n when no shear force is applied.

4. The media handling system of claim 1, wherein the adhesive material is arranged intermittently over a surface of the at least one element.

5. The media handling system of claim 1, comprising a belt with the multi-mode adhesive material disposed on a surface of the belt, the system configured to release tension in the belt to release print media from the multi-mode adhesive material on the surface of the belt.

6. The media handling system of claim 1, wherein the external influence switching the adhesive material between modes comprises strain on the adhesive.

7. The media handling system of claim 1, wherein the external influence switching the adhesive material between modes comprises ultra-violet (UV) light.

8. The media handling system of claim 1, wherein the external influence switching the adhesive material between modes comprises an electric or magnetic field.

9. A printing system comprising:

a print zone comprising an array of pens for printing a desired image on a print medium; and a plurality of elements for handling print media along a media path from a supply of print media, through the print zone and to an output for printed print media, wherein at least one element of the plurality of elements includes an adhesive material for adhering to print media for at least part of the media path;

wherein the adhesive material comprises a multi-mode adhesive material exhibiting different adhesive properties in different modes.

10. The printing system of claim 9, wherein the multi-mode adhesive material comprises a gecko-inspired adhesive (GSA) in which the different modes are switched by a change in the shear force between the adhesive material and the print media.

11. The printing system of claim 9, wherein at least one of the plurality of elements comprises one of media-pick-up subsystem; media-transport subsystem; media-hold-down subsystem; media-output subsystem.

12. The printing system of claim 9, wherein the adhesive material has a sheer adhesion coefficient greater than 5 and a detachment force of less that 0.1 N/m when no shear force is applied.

13. The printing system of claim 9, wherein the adhesive material is arranged intermittently over a surface of the at least one element.

14. The printing system of claim 9, wherein the plurality of elements comprises a belt with the multi-mode adhesive material disposed on a surface of the belt, the printing system configured to release tension in the belt to release print media from the multi-mode adhesive material on the surface of the belt.

15. The printing system of claim 9, wherein the different modes are switched by the application of an external influence.

16. A method of handling print media, the method comprising:

picking up print media from a supply of print media;

moving the print media along a media path from the print media supply to a print zone;

holding the print media in the print zone during printing on the print media; and outputting printed print media alone the media path away from the print zone to output the printed print media;

wherein at least one of the picking, moving, holding or outputting of the print media is performed with a media handling structure comprising a surface for contacting the print media where the surface comprises an adhesive material for temporarily securing print media to that media handling structure; and wherein the adhesive material comprises a multi-mode adhesive material, the multi-mode adhesive material exhibiting different adhesive properties in different modes.

17. The method claim 16, wherein the multi-mode adhesive material comprises a gecko-inspired adhesive (GSA), the method comprising removing print media from the adhesive material in a direction that does not cause adherence with the GSA.

18. The method of claim 16, wherein the multi-mode adhesive material comprises a switchable adhesive material having a first mode in which the switchable adhesive material has adhesive properties and a second mode in which the switchable adhesive material has non-adhesive properties, the method comprising switching the switchable adhesive material between the first and second modes.

* * * * *